United States Patent [19]

Deutsch

[11] Patent Number: 4,716,805

[45] Date of Patent: Jan. 5, 1988

[54] ENSEMBLE EFFECT FOR A MUSICAL TONE GENERATOR USING STORED WAVEFORMS

[75] Inventor: Ralph Deutsch, Sherman Oaks, Calif.

[73] Assignee: Kawai Musical Instrument Mfg. Co., Ltd., Hamamatsu, Japan

[21] Appl. No.: 904,314

[22] Filed: Sep. 8, 1986

[51] Int. Cl.[4] ..... G10H 1/02; G10H 7/00

[52] U.S. Cl. ..... 84/1.24; 84/DIG. 4

[58] Field of Search ..... 84/1.24, DIG. 4

[56] References Cited

U.S. PATENT DOCUMENTS

| | | | |
|---|---|---|---|
| 3,884,108 | 5/1975 | Deutsch | 84/1.24 |
| 4,112,803 | 9/1978 | Deutsch | 84/1.24 |
| 4,257,303 | 3/1981 | Nagai et al. | 84/1.24 X |
| 4,353,279 | 10/1982 | Deutsch | 84/1.24 |
| 4,429,606 | 2/1984 | Aoki | 84/1.24 X |
| 4,450,742 | 5/1984 | Sugiura | 84/1.24 X |
| 4,467,691 | 8/1984 | Deutsch | 84/1.24 |
| 4,499,808 | 2/1985 | Aoki | 84/1.24 X |

*Primary Examiner*—Stanley J. Witkowski

*Attorney, Agent, or Firm*—Ralph Deutsch

[57] ABSTRACT

A keyboard operated electronic musical instrument is disclosed in which musical tones are created by reading out preselected data values stored in a waveshape memory. A transformed sequence of these data points is generated such that a variable delay exists between the transformed sequence of data points read out of the memory. The selectively delayed sequences of points is combined with the original points to generate musical tones having an ensemble-like musical effect. Provision is made for varying the delay in a periodic cyclic fashion using a period the same as that for the stored data in the waveshape memory.

10 Claims, 7 Drawing Figures

ENSEMBLE EFFECT FOR A MUSICAL TONE GENERATOR USING STORED WAVEFORMS

BACKGROUND OF THE INVENTION

1. Field of the Invention

This invention relates to musical tone synthesis and in particular is concerned with an improvement for producing several tone variations from stored musical waveforms.

The most obvious method to imitate an acoustic musical instrument is to record the sound and to replay the recording in response to an actuated keyswitch in an array of keyswitches. An advantage to a musical tone generation system using a stored replica of a musical waveform is the ability to closely approximate the tone of an orchestral type acoustical musical instrument. One of the primary drawbacks in the implementation of this type of electronic tone generation lies in the very large numbers of data points that must be stored in a memory. For a true imitation a waveshape must be stored for each different sound and for each of the 61 keyboard switches that span the standard range of an electronic organ keyboard. Some measure of economy in the waveshape memory size requirement has been made by using a single recording for several contiguous musical notes. This economy is based upon the tacit assumption that the waveshape for the imitated acoustic musical instrument does not change markedly between several contiguous successive notes.

Electronic musical tone generators that operate by playing back recorded musical waveshapes stored in a binary digital data format have been given the generic name of PCM (Pulse Code Modulation). The name "sampled waveforms" has also been applied to the same generic systems. A musical instrument of the PCM generic type is described in U.S. Pat. No. 4,383,462 entitled "Electronic Musical Instrument." In the system described in the patent, the complete waveshape of a musical tone is stored for the attack and decay portions of the musical tone. A second memory is used to store the remainder of the tone which comprises the release phase of the musical tone. The sustain phase of the musical tone is obtained by using a third memory which stores only points for a single period of a waveshape. After the end of the decay phase, the data stored in the third memory is read out repetitively and the output data is multiplied by an envelope function generator to create the amplitude variation for the sustain and release portions of the generated musical tone.

Because of the large amount of memory required for a stored waveform PCM musical tone generation system, it is desirable to employ techniques that can generate a variety of tones from the original set of stored waveforms corresponding to the waveform of a particular selected acoustic musical instrument.

It is an object of the present invention to generate an ensemble-like tonal effect with an economical system logic.

It is a further object of the present invention to vary the phase shift of a secondary waveshape in a fashion which is adaptive to the temporal variations in the fundamental frequency of the stored musical waveform.

SUMMARY OF THE INVENTION

In a keyboard operated musical tone generator of the type in which the musical tone is generated by reading out stored waveshape data points a musical tone having an ensemble-like musical effect is generated by combining two sequences of data points. The first sequence is formed by reading out the stored waveshape data points at a memory advance rate corresponding to an actuated keyboard switch. The second sequence is formed by selecting data points from a multiple sequence of delayed waveshape data points in a time variable fashion. Each of these delay sequences has a different delay time. The selected data points are combined with the first sequence to produce the ensemble-like musical effect. Provision is made for varying the delays in a periodic fashion having a period corresponding to the period of the first sequence of data points.

BRIEF DESCRIPTION OF THE DRAWINGS

The detailed description of the invention is made with reference to the accompanying drawings.

FIG. 7 is a system schematic drawing of the invention.

DETAILED DESCRIPTION OF THE INVENTION

The present invention is directed toward a musical tone generator in which a musical waveshape is stored in a memory.

FIG. 7 shows an overall system schematic drawing of an embodiment of the present invention.

Figure 1:
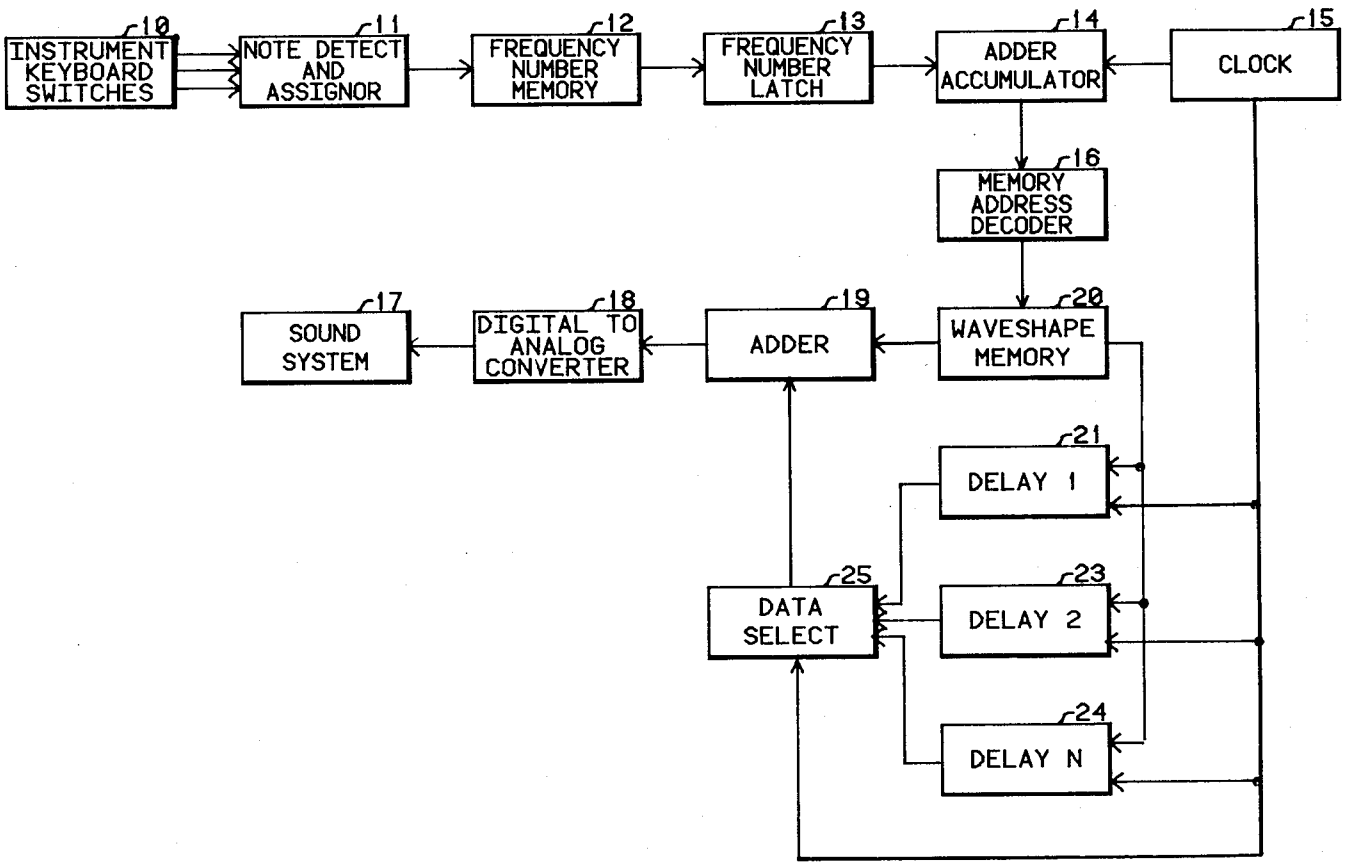
FIG. 1 is a schematic diagram of an embodiment of the invention.

FIG. 1 illustrates an embodiment of the invention showing details of one of the tone generators in the system block of FIG. 7 labelled tone generators 101. The keyboard switches are contained in the system logic block labeled instrument keyboard switches 10. If one or more of the keyboard switches has a switch status change and is actuated ("on" switch position), the note detect and assignor 11 encodes the detected keyboard switch having the status change to an actuated state and stores the corresponding note information in a memory which is contained in the note detect and assignor 11. A tone generator is assigned to each actuated keyswitch using the encoded detection data generated by and stored in the note detect and assignor 11.

Only a representative one of a plurality of tone generators, contained in the system block labelled tone generators 101 in FIG. 7, is shown in FIG. 1. The representative tone generator is composed of the system blocks 13,14,15,16,17,18,19,20,21,23,24, and 25. These blocks can be replicated for the other tone generators to provide for a polyphonic musical instrument.

A suitable configuration for a note detect and assignor subsystem is described in U.S. Pat. No. 4,022,098 entitled "Keyboard Switch Detect and Assignor." This patent is hereby incorporated by reference.

FIG. 1 explicitly shows only a single tone generator. The other tone generators for the musical instrument are simply duplicates of the same system blocks.

When the note detect and assignor 11 finds that a keyboard switch has a switch status change to an actuated switch state, a frequency number corresponding to the actuated keyswitch is read out from the frequency number memory 12 in response to the encoded detection information stored in the note detect and assignor 11. The frequency number memory 12 can be implemented as a read-only addressable memory (ROM) containing data words stored in binary numeric format having values $2^{(N-M)/12}$ where N has the range of values N=1,2, . . . , M and M is equal to the number of keyswitches on the musical instrument's keyboard. N designates the number of keyswitch. These switches are numbered consecutively from "1" at the lowest keyboard switch. The frequency numbers represent the ratios of frequencies of generated musical tones with respect to the frequency of the system's logic clock. A detailed description of frequency numbers is contained in U.S. Pat. No. 4,114,496 entitled "Note Frequency Generator For A Polyphonic Tone Synthesizer." This patent is hereby incorporated by reference.

The frequency number read out of the frequency number memory 12 is stored in the frequency number latch 13.

In response to timing signals produced by the clock 15, the frequency number contained in the frequency number latch 13 is successively added to the content of an accumulator contained in the adder-accumulator 14. The content of this accumulator is called the accumulated sum of a frequency number. Since the frequency number is less than or equal to the value one, the accumulated frequency number will consist of an integer portion and a decimal portion.

The waveshape memory 20 stores a set of data points which are stored points defining a specified musical tone. The memory address decoder 16 reads out data points stored in the waveshape memory 20 in response to the integer portion of the accumulated frequency number contained in the adder-accumulator 14.

The data points read out from the waveshape memory 20 are transferred to the adder 19 and to a plurality of data delays 21–24. While FIG. 1 explicitly shows only 3 data delays, any number N of such delays can be used. Each of the data delays 21–24 delays its input data for a different number of periods of the timing signals provided by the clock 15. At the end of the prespecified delay, each of the data delays 21–24 furnishes its delayed waveshape data point to the data select 25.

The data select 25 selects an output from one of the set of data delays 21–24 for a preselected length of time and then advances its selection to an adjacent data delay. This data selection process is continued in a cyclic manner.

The data points selected by the data select 25 are summed with the waveshape data points read out from the waveshape memory 20 by means of the adder 19. The net result produced by the adder 19 is the sum of two waveshapes where one of the waveshapes is continuously changing in phase in relation to the waveshape corresponding to the data points read out from the waveshape memory 20. This type of waveshape summation produces an ensemble-like musical tone effect.

The output data from the adder 19 is converted into an analog signal by means of the digital-to-analog converter 18. This analog signal is transformed into an audible musical sound by the sound system 17. The sound system 17 consists of a conventional amplifier and speaker combination.

An alternate implementation is to substitute a multiplier for the adder 19 as a means for combining the data points read out from the waveshape memory 20 and the data points selected by the data select 25. The use of a multiplier in place of an adder will generate tones which can have nonharmonic components.

Figure 2:
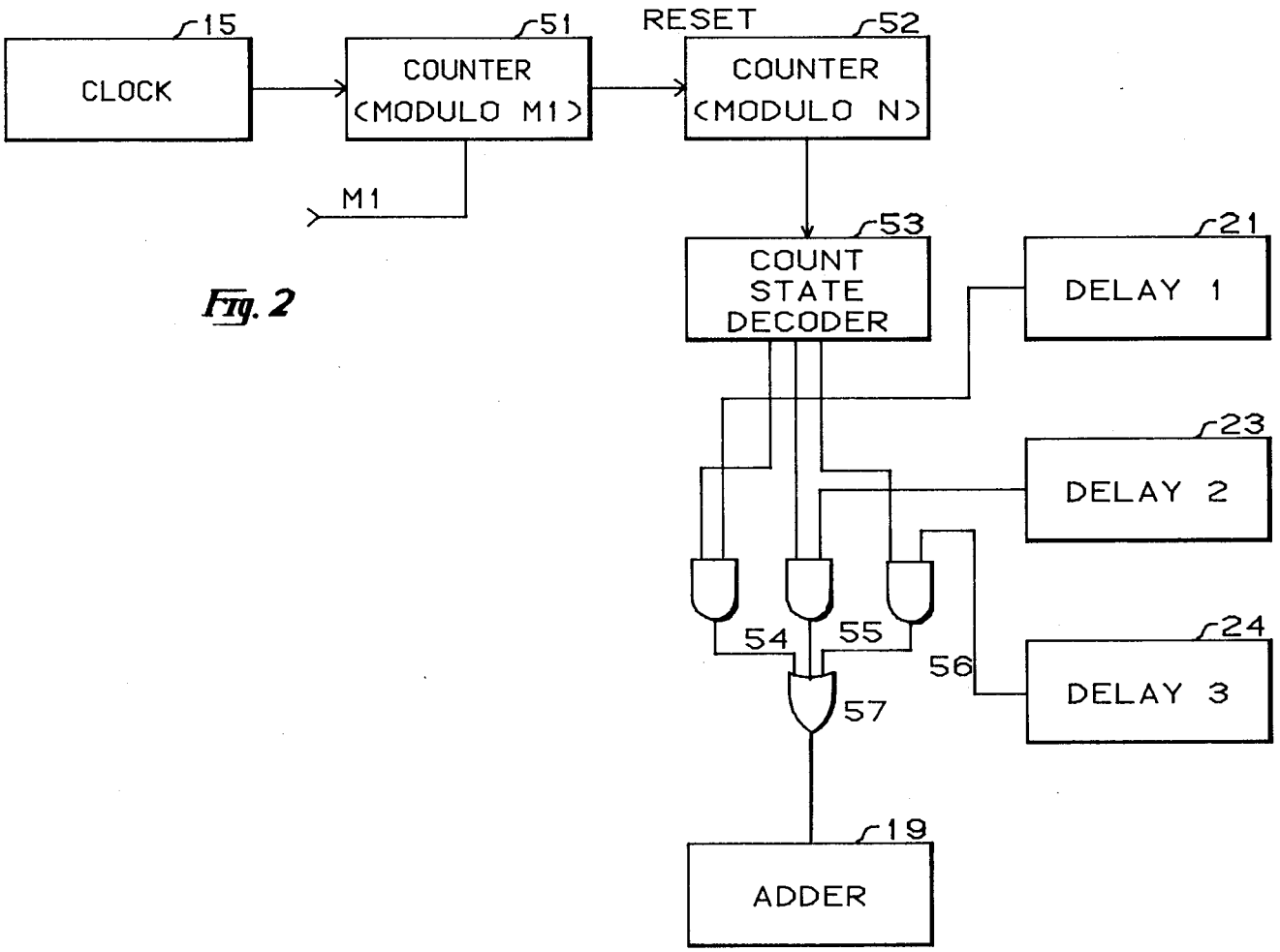
FIG. 2 is a schematic diagram of the data select 25.

The details of the logic for the data select 25 are shown in FIG. 2. The system elements labeled from 51–57 comprise the data select 25.

The counter 51 counts the signals produced by the clock 15 modulo a prespecified number M1. Each time that the counter 51 is incremented to return to its minimal count state because of its modulo counting implementation a RESET signal is generated. The counter 52 counts the sequence of RESET signal modulo the number N. N is the number of delay devices used in the system.

The count state decoder 53 decodes the binary count state of the counter 52 onto N distinct signal control lines. Each of the signal control lines is used as one input to an AND-gate in the set of AND-gates 54–56. Although only three such gates are shown explicitly in FIG. 2, it is tacitly assumed that these represent N such gates. The second input to each of the AND-gates is connected to one of the set of delays 21–24. The output of each AND-gate is connected to the OR-gate. Thus the current selected delayed data point is provided to the adder 19.

The value of the modulo number M1 determines the number of consecutive times a given delay is selected before the selection continues in the cyclic order of delays.

While only a single signal line is shown connecting a delay with an AND-gate, this is a graphical abbreviation used for clarity of the drawing. There is a line for each individual bit of the data word from a delay device as well as an AND-gate associated with each individual line.

Figure 3:
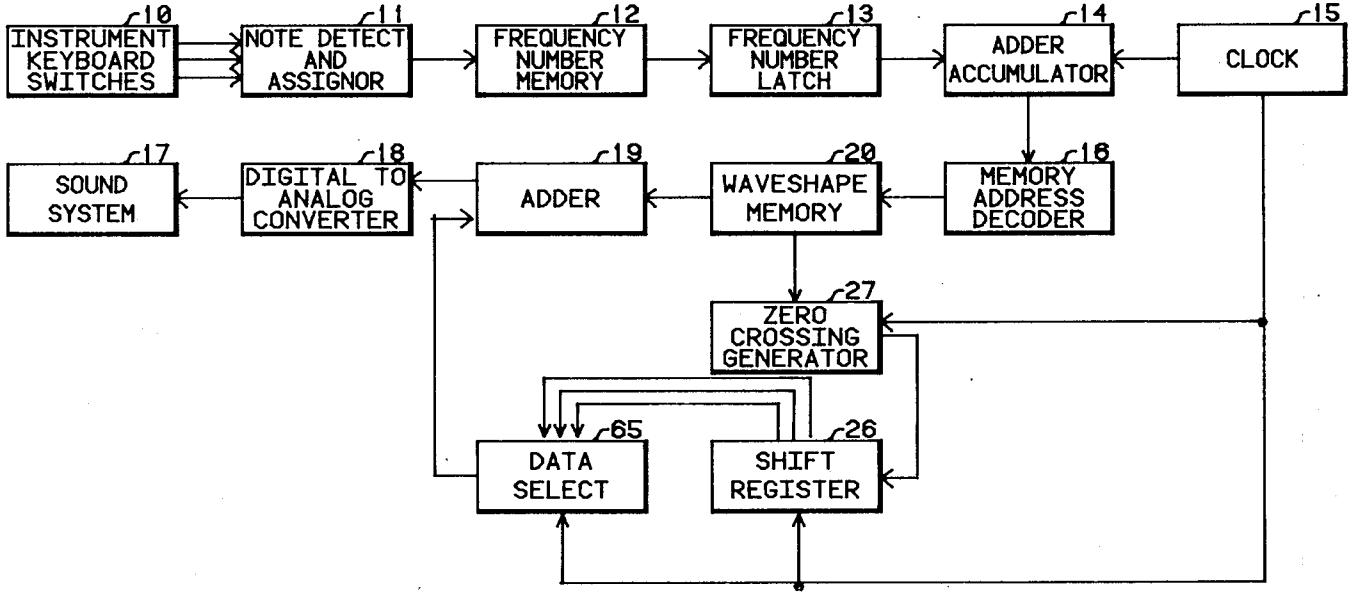
FIG. 3 is a schematic diagram of a first alternative embodiment of the invention.

An alternative implementation of the present invention is shown in FIG. 3. This implementation is based upon the signal theoretic characteristic that the major portion of the frequency information associated with a waveform is contained in a sequence formed from the zero-crossings of the waveform. The advantage gained by using the zero-crossings sequence instead of the complete waveform lies in an economy in the amount of the associate signal processing circuitry.

The waveshape data read out from the waveshape memory in response to the memory address decoder 16 is converted into a sequence of zero and one data values by means of the zero crossing generator 27. The zero crossing generator 27 can be implemented as a conventional binary signal comparator that provides a "1" binary logic state signal if the input data point has a positive or zero value and provides a "0" binary logic state signal if the input data point has a negative value.

The binary data sequence output produced by the zero crossing generator 27 is transferred to the shift register 26. The data input to the shift register is shifted in response to the timing signals provided by the clock 15. The shift register 26 is provided with a number of outputs at different bit positions so that data having different amounts of delay can be selected by the data select 65.

Figure 4:
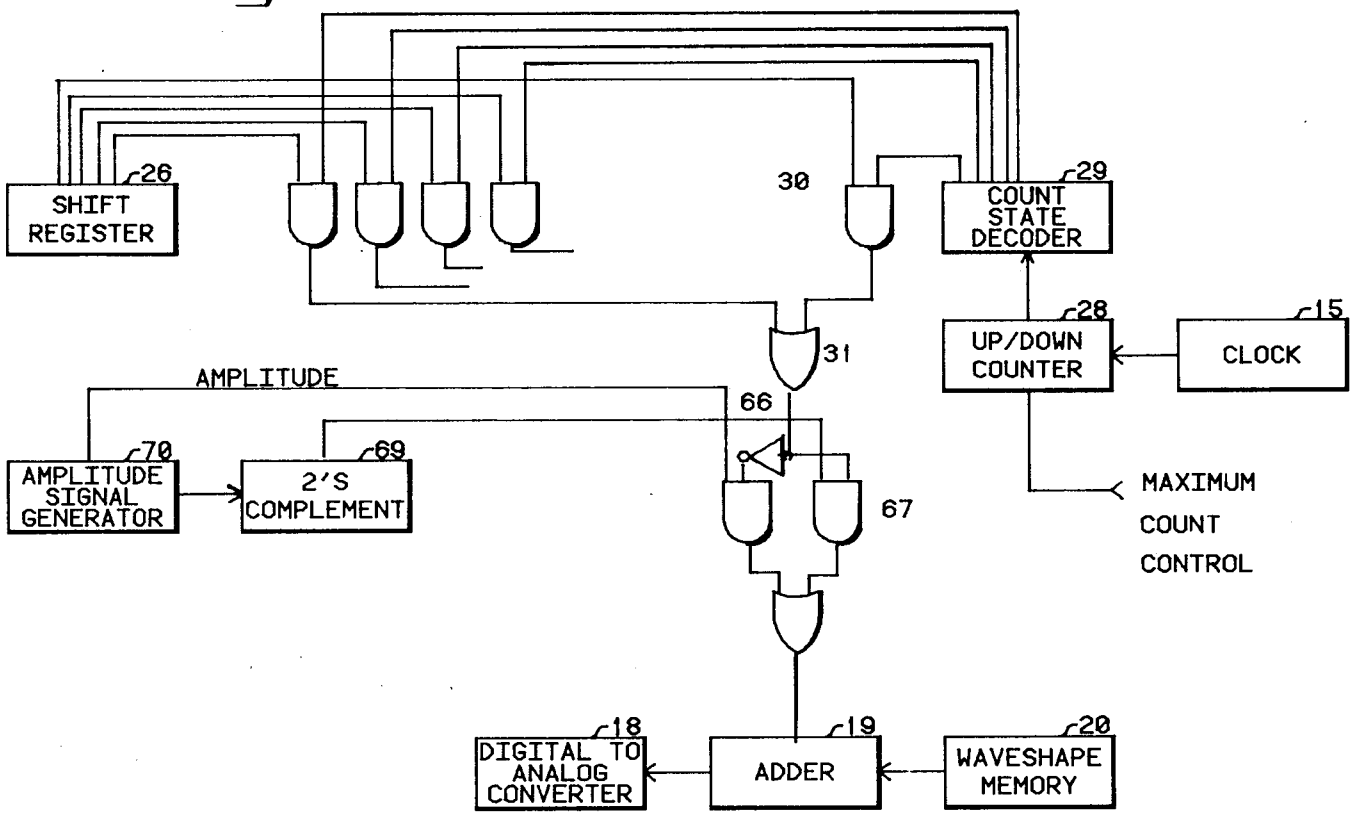
FIG. 4 is a schematic diagram of the data select 65.

The detailed logic of the data select 65 is shown in FIG. 4. The output data from each of the output ports of the shift register 26 is connected to a corresponding AND-gate in the array of AND-gates 30. The up/down counter 28 is incremented and then decremented periodically in response to the timing signals provided by the clock 15. The count states of the up/down counter 28 are decoded onto individual signal lines by means of the count state decoder 29.

The OR-gate 31 provides a binary logic "1" signal if the two inputs to any of the AND-gates in the set of AND-gates 30 both receive a binary "1" signal. If the output of the OR-gate 31 is a "1" signal, the select gate 67 will transfer the AMPLITUDE signal generated by the amplitude signal generator 70 to the adder 19. The 2's complement 69 forms the 2's complement binary operation on the AMPLITUDE signal created by the amplitude signal generator 70. If the output of the OR-gate 31 is a "0" signal, the select gate 67 will transfer the 2's complement value of the AMPLITUDE signal to the adder 19.

The amplitude signal generator 70 can be implemented as any convenient means which provides a variable signal output. This can be a simple multi-position switch in which a different binary digital numerical value is available on each contact position.

The up/down counter 28 can advantageously be implemented so that the maximum count state is variable in response to the maximum count control signal.

A variety of tonal effects can be obtained by varying the magnitude of the AMPLITUDE signal and by changing the maximum count of the up/down counter 28 in response to the maximum count control signal. One of the preferable choices for the maximum count is to set it so that the up/down counter 26 completes a count cycle in a time approximately equal to the period of the output generated musical waveshape.

Figure 5:
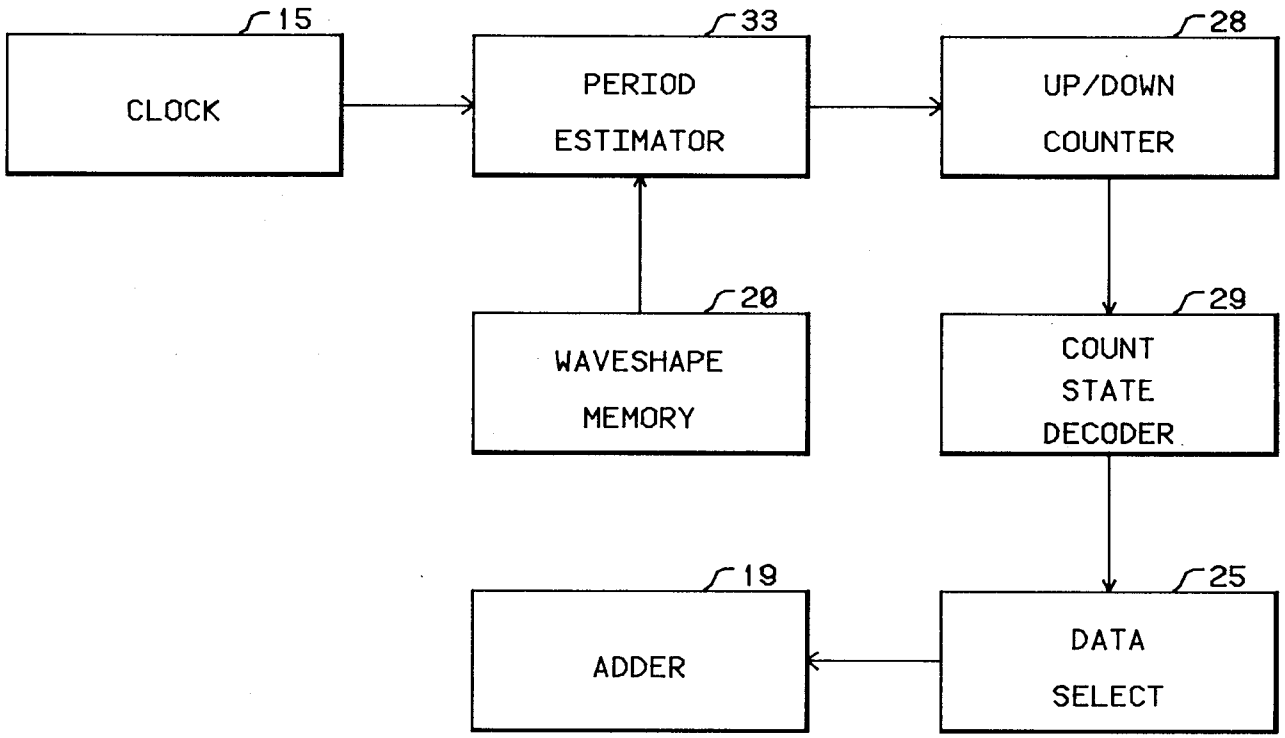
FIG. 5 is a schematic diagram of an adaptive period counter.

FIG. 5 illustrates a method of adaptively adjusting the maximum count state of the up/down counter 28 to the period of the generated musical waveshape. The key element is the period estimator 33 which provides a signal to the up/down counter 25 which corresponds to an estimate of the current instantaneous value of the period of the musical waveshape as defined by the data read out from the waveshape memory 20. The system recognizes and adapts itself to the temporal changes in the fundamental frequency of the generated musical tone.

Figure 6:
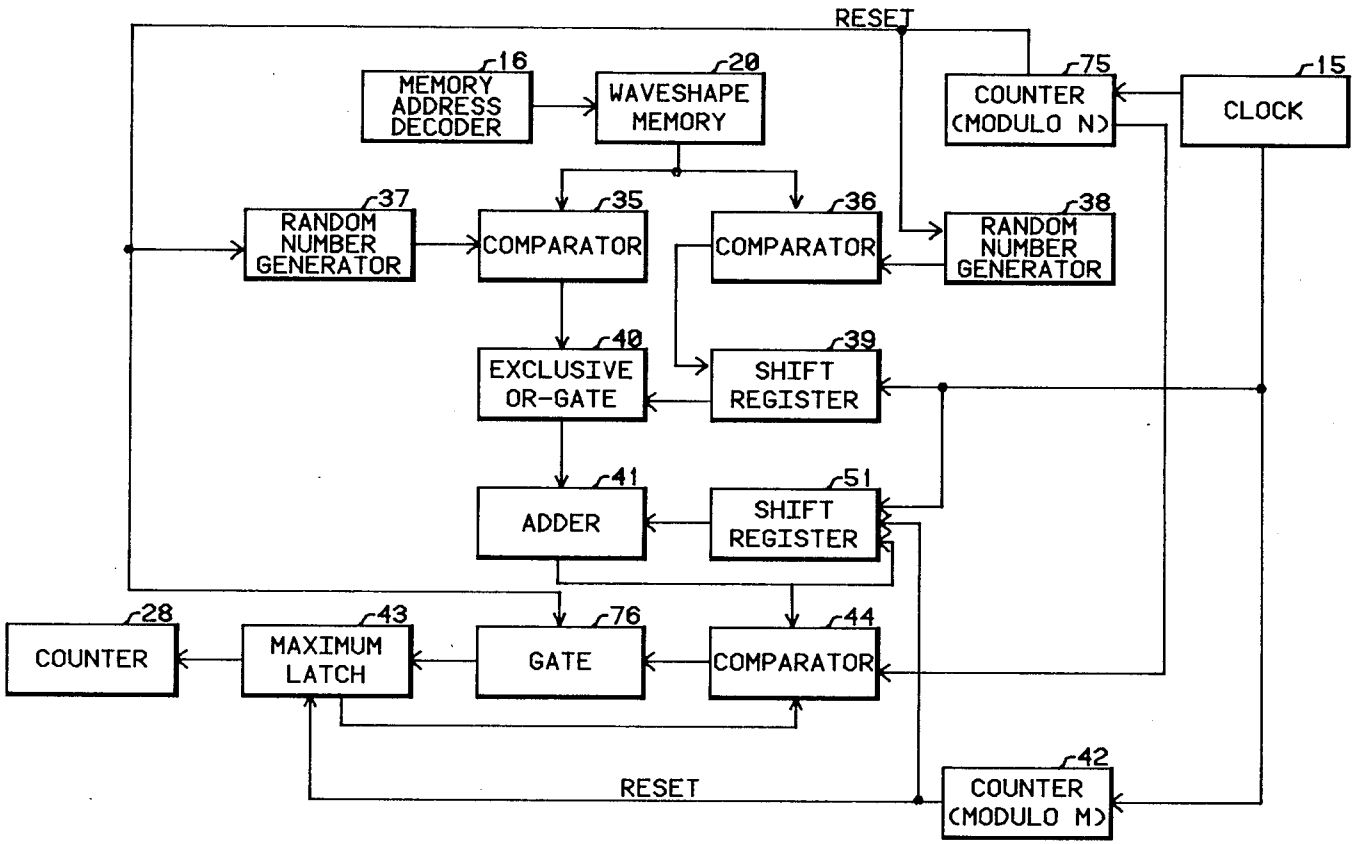
FIG. 6 is a schematic diagram of the period estimator 33.

FIG. 6 illustrates the detailed logic of the period estimator 33. The random number generators 37 and 38 generate random numbers in binary digital format which are statistically independent and are uniformly distributed to have a maximum value of B and a minimum value of −B.

A suitable implementation for a random noise generator is described in U.S. Pat. No. 4,327,419 entitled "Digital Noise Generator For Electronic Musical Instruments." This patent is hereby incorporated by reference.

The counter 75 counts the timing signals produced by the clock 15 modulo a prespecified number N. N is advantageously chosen to be about 5 to 10 times the average number of points per period of the musical waveshape stored in the waveshape memory 20. A RESET signal is generated each time counter 75 is incremented to its minimum count state.

The comparator 36 generates a logic "1" state binary signal if the data point $x_i$ read from the waveshape memory 20 is greater than or equal to the random number $y_i$ generated by the random number generator 38 in response to the RESET signal provided by the counter 75. If the data point xiread out from the waveshape memory 20 is less than the random number generated by the random number 38, a logic "0" state binary signal is generated by the comparator 36. The signals generated by the comparator 36 are stored in the shift register 39. The shift register 39 can store N data points.

The action of the comparator 36 is to compute the value of sgn $z_i$ where the variable $z_i = x_i - y_i$. Sgn denotes the mathematical signum function and the subscript i denotes a data value at a time $t_i$.

The shift register 39 is shifted in response to the timing signals produced by the clock 15 and operates in the ordinary end-around mode. That is, the data appearing at the output is recirculated and to the input data position of the shift register 39. For each data value generated by the comparator 36, the shift register 39 is shifted N times.

In the same fashion as described for comparator 36, the comparator 35 will generate a logic "1" binary state signal if the data point $x_i$ read out from the waveshape memory 20 is greater than or equal to the random number $u_i$ generated by the random number generator 37. The comparator 35 will generate a logic "0" binary state signal if the data point $x_i$ read out from the waveshape memory 20 is less than the random number $u_i$ generated by the random number generator 37. The action of the comparator 35 is to compute the value of $\mathrm{sgn} z_i = \mathrm{sgn}(x_i - u_i)$.

The period estimator 33 operates by estimating the second maximum for the autocorrelation function for the sequence of waveshape data values $x_i$ read out from the waveshape memory 20. The autocorrelation function R(q) for the sequence of values $x_i$ is defined by the relation $$R(q) = E\{x_i x_{i-q}\} \qquad \text{Eq.1}$$

where q is the time lapse between two waveshape data points $x_i$ and $x_{i-q}$ measured in the number of data points q. E{} denotes the expected value, or the statistical weighted average, of the quantity contained within the braces. Eq. 1 can be written in the following equivalent form $$R(q) = [1/(N-q)] \sum_{i=1}^{N-q} x_i x_{i-q} \qquad \text{Eq. 2}$$

where N denotes the number of pairs of data values used to form the average value.

For the system shown in FIG. 6, the autocorrelation function of Eq. 1 can be written as $$R(q) = B^2 E\{\mathrm{sgn} z_i \mathrm{sgn} z_{i-q}\} \qquad \text{Eq.3}$$

The product of the signum functions in the braces obeys the following logic truth table

| product | sign $z_i$ | sign $z_{i-q}$ |
|---|---|---|
| 1 | 1 | 1 |
| 1 | 0 | 0 |
| 0 | 1 | 0 |
| 0 | 0 | 1 |

This logic truth table is the same as the truth table for an exclusive OR-gate.

The exclusive OR-gate 40 forms the product of the signum values for each of the N previous output signum values generated by the comparator 36 with the current signum valve generated by the comparator 35. The output of the exclusive OR-gate 40 is added to the current output value from the shift register 51 and the summed value is then stored in the end position of the shift register 51. The addition of the data values is performed by means of the adder 41. The shift register 51 has the same number of data positions as the shift register 39 and both shift registers are shifted in unison.

The comparator 44 compares the output data from the adder 41 with a data value stored in the maximum latch 43. The maximum of these two values is stored in the maximum latch 43. If the data value stored in the maximum latch is changed, then the current count state of the counter 75 is also stored in the maximum latch 43. After a predetermined number of counts M, the counter 42 generates a RESET signal which indicates the termination of the estimate for the waveshape period. In response to this RESET signal, the count state stored in the maximum latch is transferred to the counter 28 to serve as the current modulo counting number. The RESET signal is also used to initialize to a zero value all the data positions of the shift register 51.

The gate 76 will not transfer data from the comparator 44 to the maximum latch 43 if the RESET signal has been generated by the counter 75. This action is necessary to prevent the autocorrelation value for a zero data spacing to be considered in estimating the period of the musical waveform. The autocorrelation function always has a maximum at the zero spacing so that this value must be inhibited in finding the spacing that provides the period information.

I claim:

1. In combination with a keyboard operated musical instrument having an array of keyswitches apparatus for producing a musical tone having ensemble effect comprising;

an assignor means whereby a detect data word is generated in response to each actuated keyswitch in said array of keyswitches and whereby one of a plurality of tone generators is assigned to each said actuated keyswitch, a frequency number generator means whereby a frequency number is generated in response to each said detect data word and whereby said frequency number is provided to an associated one of said plurality of tone generators;

said plurality of tone generators each of which comprises;

a waveshape memory for storing a preselected set of waveshape data words, a clock for providing timing signals, a memory addressing means, responsive to said timing signals, whereby said preselected set of waveshape data words are read out sequentially from said waveshape memory at a memory address advance rate responsive to said frequency number provided to said assigned tone generator, a plurality of delay means each of which delays the data words read out of from said waveshape memory by a preselected number of said timing signals, a data select means for selecting output data from one of said plurality of delay means in response to a delay control signal, a combining means for combining the output data selected by said data select means with the data words read out of said waveshape memory to form a sequence of composite data words, and a means for producing said musical tone having an ensemble effect responsive to said sequence of composite data words.

2. In a musical instrument according to claim 1 wherein said memory addressing means comprises;

an adder-accumulator means comprising an accumulator wherein the frequency number assigned to said tone generator is successively added to the contents of said accumulator in response to said timing signals to produce an accumulated frequency number, and a memory address decoding means whereby waveshape data words are read out from said waveshape memory in response to said accumulated frequency number.

3. In a musical instrument according to claim 1 wherein said plurality of delay means comprises;

a plurality of shift register means wherein each one of said shift register means has a different preselected number of total data word register positions, a register uniting means whereby data words read out from said waveshape memory are stored in one of said plurality of shift register means, and a register reading means whereby data words are read out of each of said plurality of shift register means in response to said timing signals.

4. In a musical instrument according to claim 3 wherein said data select means comprises;

a first counter for counting said timing signals modulo a number corresponding to said delay control signal wherein a reset signal is generated each time said first counter returns to its minimal count state, a select counter means for counting said reset signals modulo the number of shift register means in a set of said plurality of sets of shift register means, and a delay data select means responsive to the count state of said select counter means whereby a data word is selected from the data read out from said plurality of shift register means.

5. In combination with a keyboard operated musical instrument having an array of keyswitches, apparatus for producing musical tones having an ensemble-like effect comprising;

an assignor means whereby a detect data word is generated in response to each actuated keyswitch in said array of keyswitches and whereby one of a plurality of tone generators is assigned to each actuated keyswitch, a frequency number generator means whereby a frequency number is generated in response to each said detect data word and whereby said frequency number is provided to an associated assigned one of said plurality of tone generators, said plurality of tone generators each of which comprises;

a waveshape memory for storing a preselected set of waveshape data words, a clock for providing timing signals, a memory addressing means, responsive to said timing signals, whereby said preselected set of waveshape data words are read out sequentially from said waveshape memory at a memory address advance rate responsive to said frequency number provided to said assigned tone generator, a data transform means whereby data words read out of said waveshape memory are transformed to create a sequence of transformed data words, a delay signal means whereby data words in said sequence of transformed data words are delayed in time by a preselected number of said timing signals in response to a delay control signal, to form a delayed sequence of data words, a data select means for selecting elements of said delayed sequence of data words to form a selected sequence of data words, a combining means whereby said selected sequence of data words is combined with the data words read out from said waveshape memory to form a sequence of composite data words, and a means for producing one of said musical tones having an ensemble-like ensemble effect responsive to said sequence of composite data words.

6. In a musical instrument according to claim 5 wherein said memory addressing means comprises;

an adder-accumulator means comprising an accumulator wherein the frequency number assigned to said assigned tone generator is successively added to the contents of said accumulator in response to said timing signals to produce an accumulated frequency number, and a memory address decoding means whereby waveshape data words are read out from said waveshape memory in response to said accumulated frequency number.

7. In a musical instrument according to claim 5 said data transform means comprises;

a comparator means whereby a binary data bit having a "one" level is generated if the data word value read out of said waveshape memory has a positive or zero numerical value and whereby a binary data bit having a "zero" value is generated if the data word value read out of said waveshape memory has a negative numerical value and whereby said "one" and "zero" values comprise said sequence of transformed data words.

8. In a musical instrument according to claim 5 wherein each said delay signal means comprises;

a shift register means for storing said sequence of transformed data words, and a shifting means for simultaneously reading out a plurality of said sequence of transformed data words in response to said timing signals.

9. In a musical instrument according to claim 5 wherein said data select means comprises;

a first counter for counting said timing signals modulo a number corresponding to said delay control signal wherein a reset signal is generated each time said first counter returns to its minimal count state, an up/down counter means whose count state is periodically changed by first being incremented by each said reset signal until a predetermined maximum count state is reached and then being decremented by each said reset signal unit a predetermined minimum count state is reached, a delay data select means responsive to the count state of said up/down counter whereby a data word is selected from said sequence of transformed data words, an amplitude signal generator for generating an amplitude signal and the binary two's complement of said amplitude signal, and an amplitude select means whereby said amplitude signal is selected if a selected transformed data word has a "one" value and whereby said two's complement of said amplitude signal is selected if a selected transformed data word has a "zero" value and whereby said selected amplitude signal and said selected two's complement signal form said selected sequence of data words.

10. In a musical instrument according to claim 5 wherein said data select means comprises, a period estimator means for estimating the period of data words read out from said waveshape memory, a first counter for counting said timing signals modulo a number corresponding to said delay control signal wherein a reset signal is generated each time said first counter returns to its minimal count state, an up/down counter means for perodically counting each said reset signal between a minimal count state and a maximum count state corresponding to said estimated period of data words, a delay data select means responsive to the count state of said up/down counter whereby a data word is selected from said sequence of transformed data words, an amplitude signal generator for generating an amplitude signal and the binary two's complement of said amplitude signal, and an amplitude select means whereby said amplitude signal is selected if a selected transformed data word has a "one" value and whereby said two's complement of said amplitude signal is selected if a selected transformed data word has a "zero" value and whereby said selected amplitude sign and said selected two's complement signal form said selected sequence of data words.

* * * * *